US007073539B2

(12) United States Patent
Takimoto et al.

(10) Patent No.: US 7,073,539 B2
(45) Date of Patent: Jul. 11, 2006

(54) INDUSTRIAL TWO-LAYER FABRIC

(75) Inventors: Keiichi Takimoto, Tokyo (JP); Shigenobu Fujisawa, Tokyo (JP)

(73) Assignee: Nippon Filcon Co., Ltd., Tokyo (JP)

( * ) Notice: Subject to any disclaimer, the term of this patent is extended or adjusted under 35 U.S.C. 154(b) by 0 days.

(21) Appl. No.: 11/100,443

(22) Filed: Apr. 7, 2005

(65) Prior Publication Data

US 2005/0224130 A1 Oct. 13, 2005

(30) Foreign Application Priority Data

Apr. 9, 2004 (JP) ..... 2004-115246

(51) Int. Cl.
*D21F 3/00* (2006.01)

(52) U.S. Cl. ..... 139/383 A; 139/383 AA; 162/358.2; 162/900; 162/902

(58) Field of Classification Search ..... 139/383 A, 139/383 AA; 162/358.2, 900, 902
See application file for complete search history.

(56) References Cited

U.S. PATENT DOCUMENTS 3,094,149 A * 6/1963 Keily ..... 139/383 A
3,214,326 A * 10/1965 Lee ..... 162/205
3,664,907 A * 5/1972 Price ..... 428/57
4,161,195 A * 7/1979 Khan ..... 139/383 A
5,490,543 A * 2/1996 Fujisawa ..... 139/383 A
6,276,402 B1 * 8/2001 Herring ..... 139/383 A
6,851,457 B1 * 2/2005 Kuji ..... 139/383 A
2002/0139432 A1 10/2002 Kuji

FOREIGN PATENT DOCUMENTS

EP 0 672 782 A1 9/1995
EP 0 905 310 A2 3/1999

OTHER PUBLICATIONS

European Search Report, Application No.: 05252202.6-2314-, dated Jul. 1, 2005.

* cited by examiner

*Primary Examiner*—John J. Calvert
*Assistant Examiner*—Robert Muromoto
(74) *Attorney, Agent, or Firm*—Rader, Fishman & Grauer PLLC

(57) ABSTRACT

It is an object of the present invention to provide a fabric having superior surface property, fiber supporting property, wear resistance, water removing property, and rigidity. The fabric according to the present invention comprises an upper layer comprising an upper surface side warp, an upper surface side weft, an auxiliary weft binding yarn, and an auxiliary weft; and a running face layer disposed under the upper layer and comprising a running face side warp and running face side weft.

16 Claims, 4 Drawing Sheets

INDUSTRIAL TWO-LAYER FABRIC

TECHNICAL FILED OF THE INVENTION

The present invention relates to industrial fabrics such as a papermaking fabric, conveying belt, and filtering cloth.

DESCRIPTION OF THE RELATED ART

As an industrial fabric, a fabric woven by warps and wefts has heretofore been used broadly, and the fabric has been used, for example, in many fields such as a papermaking fabric, conveying belt, and filtering cloth, wherein fabric characteristics suitable for applications or use environments have been required. Especially a forming wire for use in a papermaking step of removing water from a raw material using meshes of the fabric has been strictly required. A fabric to which a wire mark of the fabric does not have to be transferred and which is superior in surface properties, a fabric having rigidity to such an extent that the fabric is preferably usable even in a severe environment, a fabric capable of retaining conditions required for producing satisfactory paper for a long period and the like have been required. Additionally, a fiber supporting property, enhancement of yield of a papermaking material, satisfactory water filtering property, resistance to wear, dimensional stability, running stability and the like have been required. Furthermore, in recent years, a papermaking machine has been speeded up, and therefore a papermaking wire has also been further strictly required.

Most of requirements and solutions for the industrial fabric can be understood by description of a most strictly required papermaking fabric among the industrial fabrics, and therefore the present invention will be described as a representative example of the papermaking fabric.

For example, when a papermaking speed increases, a water removing speed necessarily increases, and a water removing power needs to be increased. Consequently, needless to say, since falling of fiber or filler, and generation of the wire mark become remarkable, the fiber supporting property, and the surface property need to be further improved. When bite of wet paper increases, and sticking of fiber occurs, wet paper peelability in a case where the wet paper is transferred to felt is worsened. Since the wet paper left and formed on the fabric is pressed onto a fabric surface by the water removing power, yarns bite into the wet paper in a portion where the yarns exist. Conversely, in a portion between meshes where the yarns do not exist, the wet paper bites in the meshes, and yarn and mesh marks are generated on the wet paper surface. It is impossible to completely eliminate the wire mark, but in order to form the mark to be as small and inconspicuous as possible, an upper layer surface of the fiber is formed to be fine, and surface smoothness and fiber support property are enhanced. However, a fine fiber whose surface property and fiber supporting property are regarded as important has a bad water removing property, the fabric is basically woven with yarns having small linear diameters, and the fabric has been inferior in resistance to wear.

Moreover, the papermaking fabric runs at a high speed, and therefore a phenomenon is seen in which the fabric gradually wears by friction with a roller and the like on the side of a running face brought into contact with a machine, and life expires by the friction in some case. To enhance the resistance to wear, various measures are required, for example, a fabric pattern is formed into a weft friction pattern, or yarn material is changed. A method of giving resistance to wear especially by use of yarn having a large linear diameter is generally used. Although the wear resistance of the yarn having a large linear diameter is enhanced, it has been difficult to obtain a superior surface property.

To solve problems of both surface property and resistance to wear, a two-layer fabric has been used in which an upper layer and a running face layer are constituted using separate warps and wefts, and both layer fabrics are integrated by a binding yarn. In the two-layer fabric, a dense upper layer surface is formed using the warp and weft having small linear diameters in a papermaking surface side layer, and a running face having a large wear resistance is formed using the warp and weft having large linear diameters on the running face side layer. This method produces an effect that the fabric can be adopted in accordance with a performance required for each of the upper layer and the running face layer, and is therefore preferable.

In a case where an additional binding system is used, the binding yarn has a portion which appears on the upper surface in order to connect two layers, and therefore the yarn having a very large linear diameter cannot be used. The layers cannot be strongly connected to each other by the binding yarn having a small linear diameter and small strength. Therefore, the binding yarn is rubbed between the upper surface side layer and the running face side layer, inner friction is generated, and a problem sometimes occurs that a gap is generated in the fabric and the fabric is separated. A method has also been considered in which a large number of binding yarns are arranged to thereby enhance a binding force. However, there has been a problem that a water filtering space is narrowed by presence of the binding yarn, a water filtering property is adversely affected, or the binding yarn is woven with the upper surface side yarn in the upper layer in order to connect two fabrics to each other. When the yarn is drawn in by a binding force, a dent is given to the upper surface, and there has been a problem that the surface property of the fabric is deteriorated.

In recent years, to solve the above-described problem, a seat support binder (SSB) fabric has been broadly known using a binding yarn which also serves as an upper weft. The yarn forms the upper surface, and also has a function of weaving the upper layer and the running face layer together. The SSB type fabric is also described in Japanese Patent Application Publication No. 2001-512194. A pair of two binding yarns of this fabric are disposed between upper surface side wefts, and form the upper surface together with the upper surface side wefts. Especially in an embodiment of the publication, the upper surface side weft and a pair of binding yarns are alternately arranged, and woven together with upper warps to form a plain weave pattern. Therefore, a fabric superior in surface property, binding strength, and wear resistance of the binding yarn can be formed as compared with a conventional fabric using the binding yarn for a purpose of simply biding the yarns. However, in the above-described conventional invention, since two binding yarns are disposed between the respective wefts, a water filtering space is narrowed, and a water removing property is sometimes deteriorated.

Especially in the papermaking fabric, the fabric is sometimes finely formed for a purpose of enhancing a fiber supporting property. Limit number of weft shooting differs with the fabric pattern. In general, in the plain weave pattern having many crossing points of the warps and wefts, the number of shooting wefts cannot be increased as compared with another pattern. Even when the number of the shooting wefts is increased to a certain degree, and the fabric is formed to be fine, a pair of two binding yarns are disposed between the upper surface side wefts, therefore the water filtering space in the upper layer of the fabric and inside the fabric are filled, and the water removing property is deteriorated.

Especially as the papermaking fabric whose use environment and requirements are strict, there has been a demand for a fabric capable of obtaining a surface property, fiber supporting property, water removing property, wear resistance, rigidity, long life and the like.

SUMMARY OF THE INVENTION

According to the present invention, in view of the above-described problems, there is provided a fabric comprising: an upper surface side warp having a pattern in which the warp passes above two continuous upper surface side wefts to form a crimp having a length for two upper surface side wefts on the upper surface; an auxiliary weft forming a long crimp on the upper surface between the upper surface side wefts; and a pair of two auxiliary weft binding yarns. The fabric develops superior surface property, fiber supporting property, water removing property, wear resistance, rigidity, and long life as a papermaking, filtering, or conveying fabric.

A "long crimp" of a warp on an upper surface of a fabric according to the present invention is formed when a warp passes over two or more wefts after the warp passes under a weft and before the warp passes under another weft. Likewise, a "long crimp" of a weft on a running surface of a fabric according to the present invention is formed when a weft passes under two or more warps after the weft passes over a warp and before the weft passes over another warp.

According to the present, an industrial two-layer fabric comprises an upper layer comprising an upper surface side warp, a upper surface side weft, an auxiliary weft binding yarn, and an auxiliary weft, and a running face layer disposed under the upper layer and comprising a running face side warp and a running face side weft, wherein the upper surface side warp passes above two continuous upper surface side wefts to form a crimp having a length for two upper surface side wefts on an upper surface, and subsequently passes under two or more continuous upper surface side wefts, a pair of two auxiliary weft binding yarns are disposed between the upper surface side wefts, two auxiliary weft binding yarns alternately form the upper surface, one of the binding yarns passes above a plurality of upper surface side warps to form a long crimp for two or more warps on the upper surface, and the other binding yarn is woven together with the running face side warp so that the two auxiliary weft binding yarns connect the upper layer to the running face layer under the one binding yarn, and the auxiliary weft is disposed between other upper surface side wefts, and passes above a plurality of upper surface side warps to form a long crimp for two or more warps on the upper surface.

In the industrial two-layer fabric, the pair of auxiliary weft binding yarns and/or the auxiliary weft pattern which forms the upper surface may be a pattern in which the long crimp for a plurality of warps is formed on the upper surface except a portion in which the upper surface side warp passes above two upper surface side wefts.

Further, the pattern formed by the pair of auxiliary weft binding yarns on the upper surface may be the same as that formed by the auxiliary weft on the upper surface.

Furthermore, the pair of auxiliary weft binding yarns and the auxiliary weft may be alternately disposed between the respective upper surface side wefts.

Still further, the upper surface side warp may pass above two continuous upper surface side wefts to form a crimp for two wefts, and thereafter pass under three continuous upper surface side wefts.

Since a fabric comprises an upper surface side warp having a pattern in which the warp passes above two continuous upper surface side wefts to form a crimp having a length for two upper surface side wefts on an upper surface; an auxiliary weft which forms a long crimp between the upper surface side wefts on the upper surface; and a pair of two auxiliary weft binding yarns which form the long crimp on the upper surface and which connects an upper layer to a running face layer, the fabric produces a superior effect of developing superior surface property, fiber supporting property, water removing property, wear resistance, rigidity, and long life as a papermaking, filtering, or conveying fabric.

DETAILED DESCRIPTION OF THE INVENTION

Figure 1:
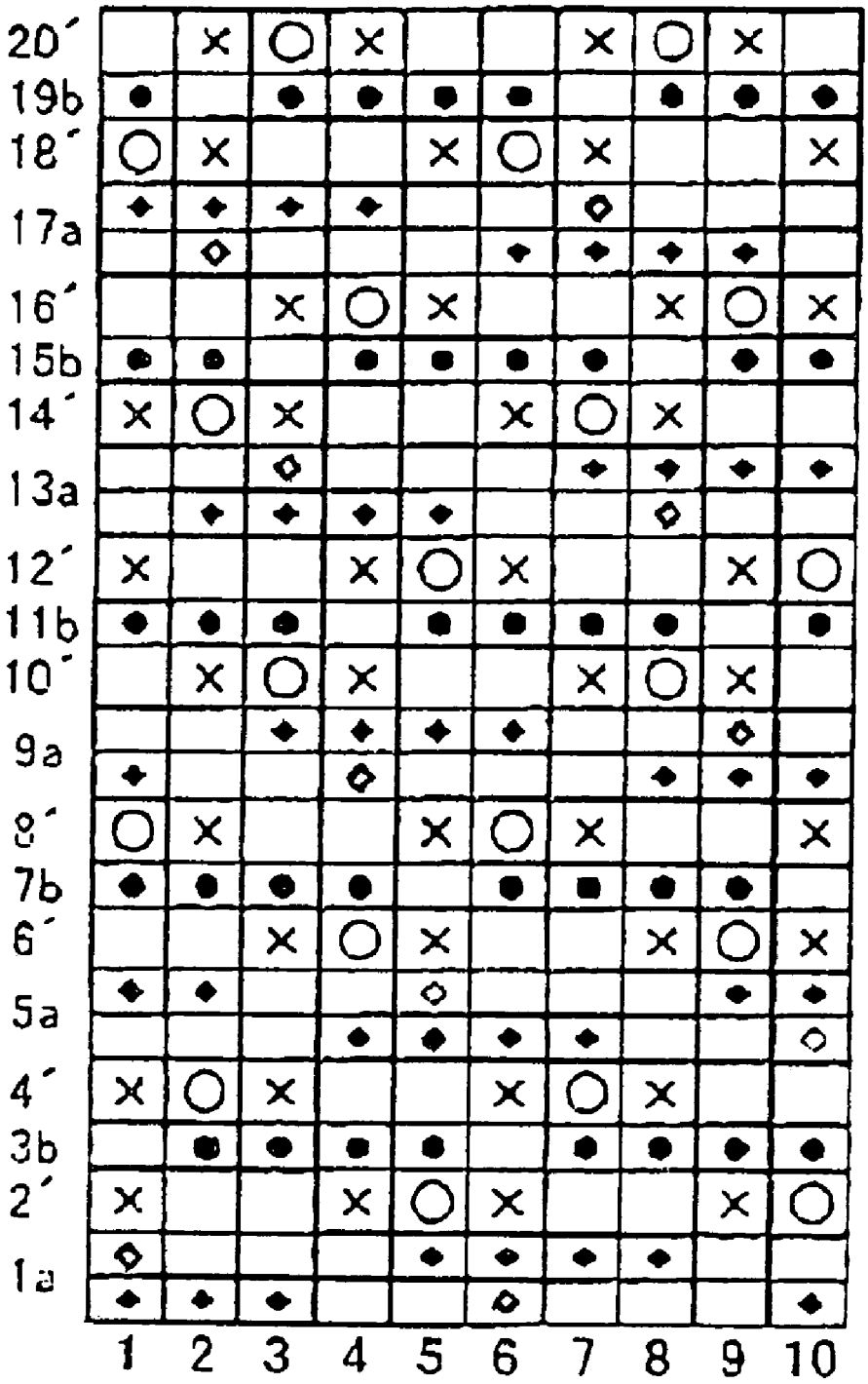
FIG. 1 is a design diagram showing a complete design or repeating unit of Example 1 according to the present invention.

An industrial fabric of the present invention is used as an industrial fabric such as a papermaking fabric, conveying belt, and filtering cloth, and is also preferably usable as a papermaker's forming fabric strictly required by a user.

The present invention relates to a two-layer fabric having a structure in which an upper layer comprising an upper surface side warp and an upper surface side weft, and a running face layer comprising a running face side warp and a running face side weft are vertically stacked. In the fabric, the upper surface side warp which passes above two continuous upper surface side wefts to form a crimp for two wefts on an upper surface, a pair of two auxiliary weft binding yarns which form a long crimp between upper surface side wefts on the upper surface and which connects the upper layer to the running face layer, and an auxiliary weft which forms a long crimp between the upper surface side wefts on the upper surface are arranged. The fabric has a weft rich structure in which many yarns in weft directions appear on the upper surface. The fabric is superior in a surface property, fiber supporting property, water removing property, rigidity, and wear resistance.

In the fabric of the present invention, the upper layer has a pattern in which the upper surface side warp passes above two continuous upper surface side wefts, and subsequently passes under two or more continuous upper surface side wefts. Especially in a pattern in which the warp passes under three or more upper surface side wefts, the fabric has a pattern in which wefts more than warps appear on the upper surface, and therefore the fiber supporting property is enhanced. Moreover, since the number of crossing points of the warps and wefts is large in a plain weave pattern, many upper wefts cannot be shooting. However, in a pattern in which the upper surface side warps pass above two upper wefts and then under two or more upper wefts as in the present invention, since the number of the crossing points is smaller than that in the plain weave pattern, the number of the shooting wefts can be increased to thereby obtain a fine fabric.

Moreover, a pair of auxiliary weft binding yarns are disposed between the upper surface side wefts in order to weave the upper layer and the running face layer. Two auxiliary weft binding yarns alternately form the upper surface, one of the yarns passes above a plurality of continuous upper surface side warps to form a long crimp for two or more warps on the upper surface, and the other binding yarn is woven together with the running face side warp to connect the upper layer to the running face layer under the one binding yarn. This auxiliary weft binding yarn alternately appears on the upper surface to function in the same manner as one upper weft. Therefore, preferably any conventional binding mark is not given to the fabric surface. However, when two auxiliary weft binding yarns are disposed to thereby weave the upper surface and running face layer, the water filtering spaces in the fabric surface and inside the fabric are closed especially in the fine fabric, and the water filtering property is unavoidably poor.

To solve the problem, in addition to the auxiliary weft binding yarn, one auxiliary weft which does not have a binding function was disposed between the wefts in order to increase the water filtering space without deteriorating the fiber supporting property and the surface property. Since the auxiliary weft is disposed between the upper surface side wefts, and passes above a plurality of upper surface side warps to form a long crimp for two or more warps on the upper surface, sufficient fiber supporting property is obtained. Since the auxiliary weft is woven only with the upper surface side warp unlike the auxiliary weft binding yarn, the water filtering space in the fabric is not filled, and appropriate water removing property can be obtained.

As to an arrangement ratio of auxiliary weft binding yarn and auxiliary weft, when the number of auxiliary weft binding yarns is excessively decreased, binding strength drops, two-layer fabric sometimes peels, and the ratio needs to be selected in accordance with a purpose and application. However, when excessively many yarns are arranged, the water filtering space is closed, and the water removing property is not obtained. The arrangement ratio of the auxiliary weft binding yarn and the auxiliary weft needs to be sufficiently studied. The auxiliary weft binding yarn and the auxiliary weft do not have to be disposed between the respective upper surface side wefts. However, in a case where the fiber supporting property and surface property are regarded as important, either yarn may be disposed between the respective upper surface side wefts.

Moreover, a pattern of the auxiliary weft binding yarn and the auxiliary weft may be a pattern in which a long crimp for a plurality of warps is formed on the upper surface. This pattern in which the long crimp is formed contributes to the increase of the surface property, fiber supporting property, and shooting limit of wefts. Especially, the upper surface may have a pattern in which the long crimp for a plurality of warps is formed in addition to a portion in which the upper surface side warp passes above two upper surface side wefts. In this pattern, a comparatively long crimp can be formed.

The pattern of the auxiliary weft binding yarn may be the same as or different from that of the auxiliary weft, but the fabric is superior in surface property ad uniform in the same pattern.

The running face side pattern is not especially limited, but the wear resistance can be enhanced in a pattern in which the weft long crimp is formed on the running face side surface as in the present embodiment.

The yarns for use in the present invention may be selected in accordance with the application or the functions of the respective yarns on the fabric. For example, in addition to mono filaments, multi filaments, spun yarns, processed yarns generally referred to as textured yarns, bulky yarns, and stretch yarns subjected to crimping or bulking, or yarns which are intertwined or combined otherwise are usable. A sectional shape of the yarn is not limited to a circular shape, and short yarns such as tetragonal and star-shaped yarns, elliptical yarns, and hollow yarns are usable. A yarn material can be freely selected, and polyester, nylon, polyphenylene sulfide, poly vinyliden fluoride, polypro, aramid, polyether ether ketone, polyethylene naphthalate, polytetrafluoro ethylene, cotton, wool, metal and the like are usable. Needless to say, yarns of copolymer or the materials blended with or containing various materials in accordance with the purpose may be used.

As the industrial fabric, in general, polyester monofilament superior in rigidity and dimensional stability is preferably used, and the fabric can be appropriately selected from properties, weavability and the like of the fabric. The polyester filaments and nylon monofilaments are alternately arranged as the case may be, and combined weaving is preferable because the wear resistance can be enhanced while enhancing the rigidity. Linear diameters may be selected in accordance with the application or aptitude, and the upper surface side weft, auxiliary weft, and auxiliary weft binding yarn may have an equal or different linear diameter, and the same or different material. For example, the linear diameters of the auxiliary weft and the auxiliary weft binding yarn may be smaller than those of the upper surface side wefts in order to fill in gaps among the upper surface side wefts, the linear diameter of the yarn constituting the running face layer may be larger than that of the yarn constituting the upper surface in order to enhance the wear resistance, and the linear diameter is appropriately usable.

EXAMPLES

A mode for carrying out the present invention will be described in accordance with examples with reference to the drawings.

Figure 2:
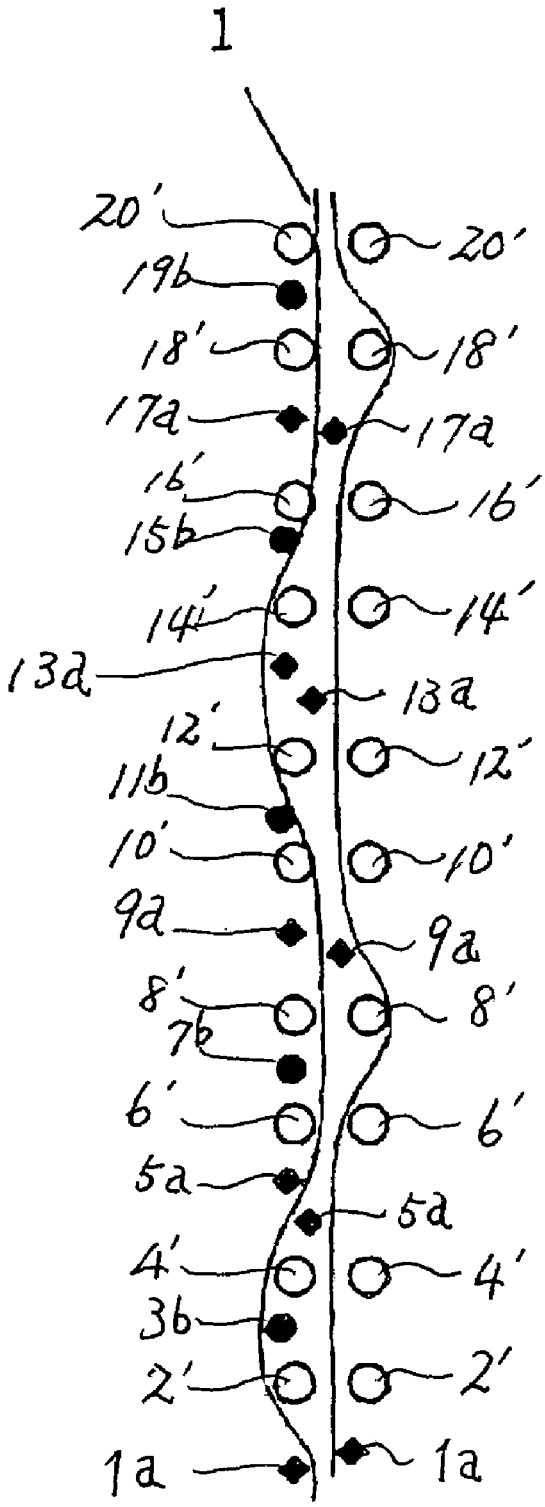
FIG. 2 is a sectional view thereof taken along a warp 1 of FIG. 1 of Example 1.
Figure 3:
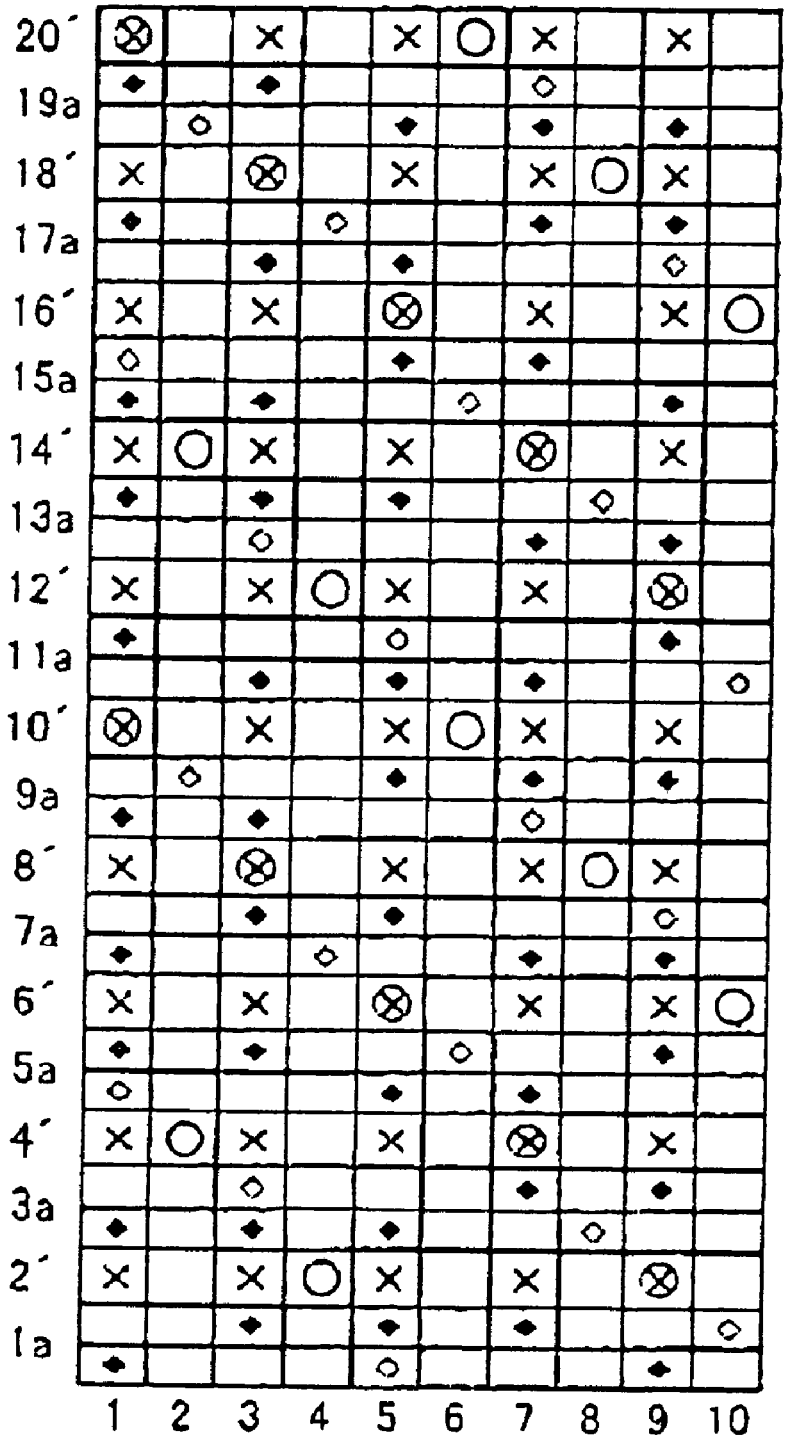
FIG. 3 PRIOR ART
FIG. 3 is a design diagram thereof showing a complete design or repeating unit of Conventional Example 1 of the present invention.
Figure 4:
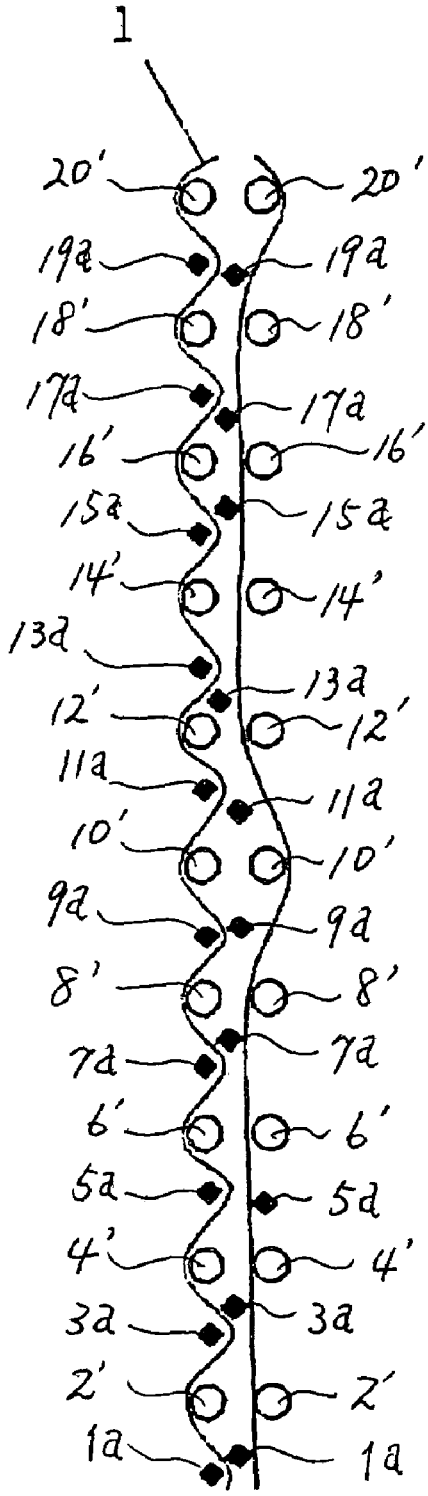
FIG. 4 PRIOR ART
FIG. 4 is a sectional view thereof taken along a warp 1 of FIG. 3 of Conventional Example 1.

FIG. 1 is a design diagram showing a complete design or repeating unit of the example of the present invention, and FIG. 2 is a sectional view along a warp 1 of a fabric of FIG. 1. FIG. 3 is a design diagram showing a complete design or repeating unit of Conventional Example 1, and FIG. 4 is a sectional view along the warp 1 of the fabric of FIG. 3.

Both the fabrics are two-layer fabrics in which an upper layer is connected to a running face layer by a set of auxiliary weft binding yarns arranged between upper surface side wefts. In the design diagram, warps are denoted with Arabic numerals such as 1, 2, 3. Wefts are denoted with Arabic numerals with prime such as 2 prime, 4 prime, 6 prime, and upper surface side wefts are vertically superimposed upon running face side wefts. A pair of auxiliary weft binding yarns are denoted with Arabic numerals to which a is affixed, such as 1*a*, 5*a*, 9*a*, and auxiliary wefts are denoted with Arabic numerals to which b is affixed, such as 3*b*, 7*b*, 11*b*. Mark X indicates that an upper surface side warp passes above an upper surface side weft and appears on the upper surface. Mark ○ indicates that a running face side warp passes under a running face side weft. Moreover, mark ♦ indicates that an auxiliary weft binding yarn passes above the upper surface side warp and appears on the upper surface, and mark ◇ indicates that the auxiliary weft binding yarn passes under the running face side warp to bind a running face layer. Mark ● indicates that the auxiliary weft passes above the upper surface side warp and appears on the upper surface. In the examples of the present invention, in the design diagrams, the warps and wefts are vertically superimposed and arranged for the sake of convenience, but the yarns are sometimes shifted and arranged in an actual fabric.

Next, the mode for carrying out the present invention will be described in accordance with examples with reference to the drawings.

Example 1

A design diagram of FIG. 1 shows a complete design or repeating unit of Example 1 of the present invention, and an upper layer formed by upper surface side warps and upper surface side wefts, and a running face layer formed by running face side warps and running face side wefts are woven together by a pair of auxiliary weft binding yarns disposed between the upper surface side wefts. The pair of auxiliary weft binding yarns and one auxiliary weft are alternately arranged between the respective upper surface side wefts to form the upper layer.

The upper surface side warp has a pattern in which the warp passes above two continuous wefts, and passes under three upper surface side wefts as seen from a warp 1 of FIG. 2. In this pattern, a fiber supporting property of the weft is enhanced. The number of shooting yarns can be increased as compared with a fabric having a plain weave pattern with an equal linear diameter.

Moreover, the pair of auxiliary weft binding yarns were disposed between the upper surface side wefts. In FIG. 1, reference numerals 1*a*, 5*a*, 9*a*, 13*a*, 17*a* denote pairs of auxiliary weft binding yarns, one of the auxiliary weft binding yarns binds the running face side under a portion forming an upper surface, and the other yarn is positioned under the one yarn to bind the running face layer. One auxiliary weft binding yarn passes above four continuous warps, forms a long knuckle on the upper surface, next passes between two upper surface side and running face side warps, passes under one running face side warp to bind the running face layer, and next passes between three upper surface side warps and the running face side warps in the pattern. Moreover, two yarns forming the pair alternately appear on the upper surface, function as one weft, and repeatedly forms a ¼ pattern in which the yarns pass above four continuous warps and next under one warp. A connecting portion of the running face layer may pass under at least one running face side warp, and one or about two warps are preferable. Needless to say, more warps may be used, and the warps may be selected in consideration of the patterns of the upper surface and running face side and the like.

Moreover, reference numerals 3*b*, 7*b*, 11*b*, 15*b*, 19*b* denote auxiliary wefts, and the wefts are woven together with the upper surface side warps. The pattern of the auxiliary weft is a pattern in which the weft passes above four continuous upper surface side warps and under one upper surface side warp, and is the same as a pattern formed on the surface by the auxiliary weft binding yarns. The present invention is not limited to the forming of the same pattern as that of the auxiliary weft binding yarns, and any pattern may be formed as long as the yarns pass above a plurality of upper surface side warps to form a long crimp on the upper surface. A pair of auxiliary weft binding yarns are arranged between the upper surface side wefts, and are woven with both the upper surface side warp and the running face side warp, but each auxiliary weft is disposed between the upper surface side wefts, and woven only with the upper surface side warp. As to a fabric in which only the auxiliary weft binding yarns are disposed between the upper surface side wefts, the water filtering space in the fabric surface and inside the fabric are closed, and a water removing property sometimes becomes defective. However, when the auxiliary wefts woven only with the upper surface side warps are disposed in several places as in the present invention, the water filtering space in the fabric can be secured, and an appropriate water removing property is obtained.

An arrangement ratio of the auxiliary weft and the auxiliary weft binding yarn may be selected in accordance with a purpose or a situation, the yarn may be alternately disposed as in Example 1, or a portion may be disposed in which any auxiliary weft binding yarn or auxiliary weft is not disposed between the upper surface side wefts. When a surface property is required, the arrangement needs to be sufficiently considered. In the present example, as to the pattern including the pair of auxiliary weft binding yarns and the auxiliary weft, in a portion other than a portion of the upper surface side warp passing above two continuous upper surface side wefts, a pattern was formed in which the wefts appeared on the upper surface to form a long crimp for four warps on the upper surface. The auxiliary weft binding yarns and the auxiliary weft also have a purpose of enhancing a fiber supporting property, and a crimp long in a transverse direction is preferably formed.

A running face layer pattern is not especially limited, but wear resistance can be enhanced in a pattern in which the long crimp of the wefts is formed on the running surface as in the present example. Furthermore, the running face side weft is formed into a structure in which polyester monofilaments and polyamide monofilaments are alternately arranged. Then, while securing rigidity, the wear resistance can be enhanced.

As described above, in the pattern, the upper surface side warp passing above two continuous upper surface side wefts and then under two or more continuous upper surface side wefts, the auxiliary weft and the pair of auxiliary weft binding yarns which form the long crimp on the upper surface are arranged. Consequently, the industrial two-layer fabric can be achieved which is superior in surface property, fiber supporting property, water removing property, rigidity, and wear resistance.

Conventional Example 1

A design diagram of FIG. 3 shows a complete design or repeating unit of Conventional Example 1, and an upper surface formed by an upper surface side warp and an upper surface side weft, and a running face layer formed by a running face side warp and a running face side weft are woven by a pair of auxiliary weft binding yarns arranged between upper surface side wefts.

In an upper surface, a pair of auxiliary weft binding yarns are arranged between the respective upper surface side wefts, and the auxiliary weft binding yarns have a function of weaving the upper layer and the running face layer, and a function of forming the upper layer. The auxiliary weft binding yarns alternately appear on the upper surface to form a plain weave pattern, and one yarn forms the upper surface whereas the other yarn binds the running face layer under the one yarn. The pair of auxiliary weft binding yarns form a plain weave pattern for one upper surface side weft on the upper surface. Moreover, the plain weave pattern is formed in which the pattern of the upper surface side weft passing above and under one upper surface side warp is repeated. That is, the upper surface is formed into the plain weave pattern by the upper surface side warp, the upper surface side weft, and the pair of auxiliary weft binding yarns.

However, in Conventional Example 1, since two auxiliary weft binding yarns are disposed between the respective upper surface side wefts, the water filtering spaces in the upper surface and inside the fabric are closed by the auxiliary weft binding yarns, and a sufficient water removing property cannot be secured.

Moreover, since the fabric of Conventional Example 1 has the plain weave pattern in the upper layer, there are many crossing points between the warps and the wefts, and therefore a shooting limit of the wefts is reduced. It is difficult to weave a fabric having a large number of shooting yarns.

As described above, when a fabric having an increased number of shooting yarns is achieved in order to enhance a surface property and a fiber supporting property, a upper surface side warp pattern is formed into a pattern in which the warp passes above two continuous upper surface side wefts to form a crimp having a length for two upper surface side wefts on the upper surface, and next passes under two or more continuous upper surface side wefts. Moreover, an auxiliary weft binding yarn and an auxiliary weft forming a long crimp are arranged between the upper surface side wefts. To obtain appropriate air passing even when the number of shooting yarns is large, a two-layer fabric of the present invention may be formed in which the auxiliary weft to be woven with the upper surface side warp is disposed instead of the auxiliary weft binding yarn.

An industrial two-layer fabric of the present invention is used as a papermaking, filtering, or conveying fabric.

Thus the present invention possesses a number of advantages or purposes, and there is no requirement that every claim directed to that invention be limited to encompass all of them.

The disclosure of Japanese Patent Application No. 2004-115246 filed on Apr. 9, 2004 including specification, drawings and claims is incorporated herein by reference in its entirety.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. An industrial two-layer fabric comprising: an upper layer comprising an upper surface side warp, an upper surface side weft, an auxiliary weft binding yarn, and an auxiliary weft; and a running face layer disposed under the upper layer and comprising a running face side warp and a running face side weft, wherein the upper surface side warp passes above two continuous upper surface side wefts to form a crimp having a length for two upper surface side wefts on an upper surface, and subsequently passes under two or more continuous upper surface side wefts, a pair of two auxiliary weft binding yarns are disposed between the upper surface side wefts, two auxiliary weft binding yarns alternately form the upper surface, one of the binding yarns passes above a plurality of upper surface side warps to form a long crimp for two or more warps on the upper surface, and the other binding yarn is woven together with the running face side warp so that the two auxiliary weft binding yarns connect the upper layer to the running face layer under the one binding yarn, and the auxiliary weft is disposed between other upper surface side wefts, and passes above a plurality of upper surface side warps to form a long crimp for two or more warps on the upper surface.

2. The industrial two-layer fabric according to claim 1, wherein the pair of auxiliary weft binding yarns and/or the auxiliary weft pattern which forms the upper surface is a pattern in which the long crimp for a plurality of warps is formed on the upper surface except a portion in which the upper surface side warp passes above two upper surface side wefts.

3. The industrial two-layer fabric according to claim 1, wherein the pattern formed by the pair of auxiliary weft binding yarns on the upper surface is the same as that formed by the auxiliary weft on the upper surface.

4. The industrial two-layer fabric according to claim 2, wherein the pattern formed by the pair of auxiliary weft binding yarns on the upper surface is the same as that formed by the auxiliary weft on the upper surface.

5. The industrial two-layer fabric according to claim 1, wherein the pair of auxiliary weft binding yarns and the auxiliary weft are alternately disposed between the respective upper surface side wefts.

6. The industrial two-layer fabric according to claim 2, wherein the pair of auxiliary weft binding yarns and the auxiliary weft are alternately disposed between the respective upper surface side wefts.

7. The industrial two-layer fabric according to claim 3, wherein the pair of auxiliary weft binding yarns and the auxiliary weft are alternately disposed between the respective upper surface side wefts.

8. The industrial two-layer fabric according to claim 4, wherein the pair of auxiliary weft binding yarns and the auxiliary weft are alternately disposed between the respective upper surface side wefts.

9. The industrial two-layer fabric according to claim 1, wherein the upper surface side warp passes above two continuous upper surface side wefts to form a crimp for two wefts, and thereafter passes under three continuous upper surface side wefts.

10. The industrial two-layer fabric according to claim 2, wherein the upper surface side warp passes above two continuous upper surface side wefts to form a crimp for two wefts, and thereafter passes under three continuous upper surface side wefts.

11. The industrial two-layer fabric according to claim 3, wherein the upper surface side warp passes above two continuous upper surface side wefts to form a crimp for two wefts, and thereafter passes under three continuous upper surface side wefts.

12. The industrial two-layer fabric according to claim 4, wherein the upper surface side warp passes above two continuous upper surface side wefts to form a crimp for two wefts, and thereafter passes under three continuous upper surface side wefts.

13. The industrial two-layer fabric according to claim 5, wherein the upper surface side warp passes above two continuous upper surface side wefts to form a crimp for two wefts, and thereafter passes under three continuous upper surface side wefts.

14. The industrial two-layer fabric according to claim 6, wherein the upper surface side warp passes above two continuous upper surface side wefts to form a crimp for two wefts, and thereafter passes under three continuous upper surface side wefts.

15. The industrial two-layer fabric according to claim 7, wherein the upper surface side warp passes above two continuous upper surface side wefts to form a crimp for two wefts, and thereafter passes under three continuous upper surface side wefts.

16. The industrial two-layer fabric according to claim 8, wherein the upper surface side warp passes above two continuous upper surface side wefts to form a crimp for two wefts, and thereafter passes under three continuous upper surface side wefts.

* * * * *